US006050213A

United States Patent [19]

Stevens

[11] Patent Number: 6,050,213

[45] Date of Patent: Apr. 18, 2000

[54] KAYAK BEVERAGE HOLDER

[76] Inventor: David Alexander Stevens, 11403 Crestwood Dr. South, Seattle, Wash. 98178

[21] Appl. No.: 09/294,629

[22] Filed: Apr. 19, 1999

[51] Int. Cl.[7] ..... B63B 17/00

[52] U.S. Cl. ..... 114/364; 114/347

[58] Field of Search ..... 248/503; 410/97, 410/118; 114/347, 364

[56] References Cited

U.S. PATENT DOCUMENTS 4,901,961 2/1990 Gish ..... 248/217.2
5,042,770 8/1991 Louthan ..... 248/311.2
5,695,162 12/1997 DiCastro ..... 248/231.81
5,938,091 8/1999 Bergin et al. ..... 224/411
5,941,434 8/1999 Green ..... 224/250

*Primary Examiner*—Stephen Avila

[57] ABSTRACT

The Kayak Beverage Holder is a device used for securely holding and providing easy access to standard sized beverage containers while operating a sea or river kayak equipped with stretch cord material on the deck which is used for temporarily securing the device to the kayak deck.

1 Claim, 2 Drawing Sheets

KAYAK BEVERAGE HOLDER

BACKGROUND OF THE KAYAK BEVERAGE HOLDER

The Kayak Beverage Holder was invented to enhance the safety and enjoyment of sea or river kayak operation. Normal and safe operation of a kayak designed for sea or river involves the use of a device known as a spray-skirt. The spray skirt, worn around the waist of the operator and physically connected to the cockpit of the craft, prevents dangerous waves or spray from entering the opening. The opening is sealed and any items inside the boat are inaccessible when the spray-skirt is employed. As in all physical activities, proper hydration is important. Access to beverages after embarking on a kayak very often requires the removal of the spray-skirt. Minimizing the exposure to surrounding waves is critical to safe operation of the craft. Once obtained and the spray-skirt reset, a beverage must have a place to rest until completed. Standard kayak design does not incorporate an exterior receptacle for standard beverage containers. Since the majority of beverage containers are in the form of a standard 12 ounce aluminum can or a slightly smaller diameter bottle, a way to securely hold these types of containers in reach of the kayak operator while under way is important to safe and pleasurable operation. The kayak beverage holder is designed to provide this utility.

Prior Art

In U.S. Pat. No. 5,695,162, DiCastro shows a cup holder designed for specific use on the arm of a stadium seat. In U.S. Pat. No. 5,941,434, Green shows a universal holding device in which a beverage may be optionally secured. In U.S. Pat. No. 5,042,770, Louthan shows a beverage holder with a variety of receiver attachment options including fastening to vertical and horizontal rods or table-top edges. In U.S. Pat. No. 5,938,091, Bergin et al shows a beverage holder designed specifically for attachment to the vertical side of a shopping cart. In U.S. Pat. No. 4,901,961, Gish shows a device to stabilize a variety of objects on a humped or flat carpeted surface.

In the first, third, and fourth examples, the specific objective of securing a cup or beverage container is shared. Each of these devices have attachment structures, connected to the container-holding component, designed with varying degrees of flexibility for use outside their intended application. No manipulation of any of the attachment components shown could result in adherence or mechanical connection to the deck surface of a kayak for the purpose of firmly supporting their beverage container holding components in an upright manner. In the second example, Green's device shows securing a beverage container as a possible option. Whatever object is being secured, Green's description limits attachment of the device to a "waistband, belt, or other, suitably-shaped, receiving structure." The clip component shown in the design drawings clearly limits attachment to a thin, band-like receiving structure. This type of receiving structure does not exist on a kayak deck. The fifth example shows Gish's device securing a number of possible accessory items, including a beverage container caddy, to a humped or flat, carpeted surface. The base structure requires a carpet surface to allow attachnment rendering it unusable on the deck of a kayak.

The Kayak Beverage Holder differs from all of these examples of prior art by providing a unique base that accommodates varying kayak deck surface shapes. It also utilizes a stretch cord configuration commonly installed on a kayak forward deck as a means to neatly and securely incorporate the device to the deck surface. The four vertical posts extending from the base's corners to an optimal height allow a common can or bottle to be inserted or removed within convenient reach keeping the contents sufficiently upright to avoid spillage even when the kayak is pitching in rough sea or river conditions.

Brief Summary of the Kayak Beverage Holder

The Kayak Beverage Holder is a single unit with no moving or removable parts which is constructed to allow the secure insertion and easy removal of a standard 12 ounce aluminum can or 12 ounce glass bottle. The Kayak Beverage Holder is held firmly to the top of the kayak by means of stretch cord material fastened to the deck either integrated during manufacture of the kayak or added later by the owner/operator.

DESCRIPTION OF THE 4 VIEWS OF THE KAYAK BEVERAGE HOLDER

Please refer to two (2) pages of drawings attached to this application.

FIG. 1 represents the view of the Kayak Beverage Holder facing the user while under way. Shown are the body, vertical posts used to secure the beverage container, and the tunnel underneath the unit which provides clearance for a flat, rounded, or "V" shaped deck. Also indicated are the rubber bases attached to the parallel bottom sections providing a non-skid contact surface.

FIG. 2 represents the top view of the Kayak Beverage Holder. Indicated are the four vertical post positions within which a beverage container is held and three channels cris-crossing the top. The channels are used to confine 0.25" stretch cord material used to secure the Kayak Beverage Holder to the deck. When the stretch cord material is configured on the deck to cross two lengths over one another in an X pattern, the two crossed channels are used. When a single cord spans the deck, the single center channel is used. Both stretch cord configurations are commonly found on sea and river kayaks.

DETAILED DESCRIPTION OF THE KAYAK BEVERAGE HOLDER

Figure 1:
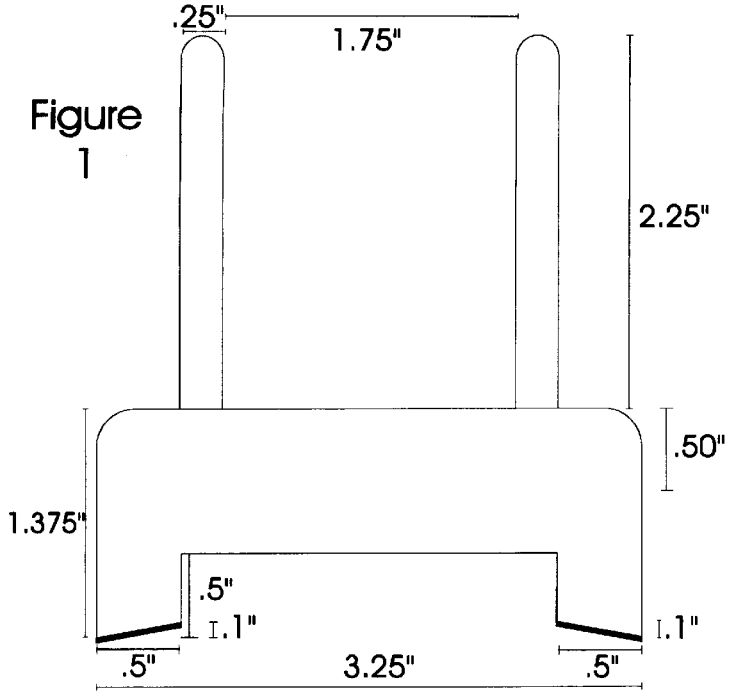
Figure 2:
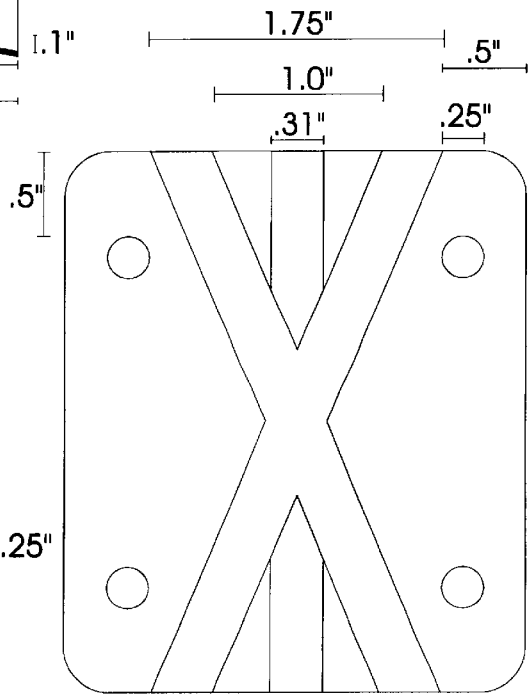
Figure 3:
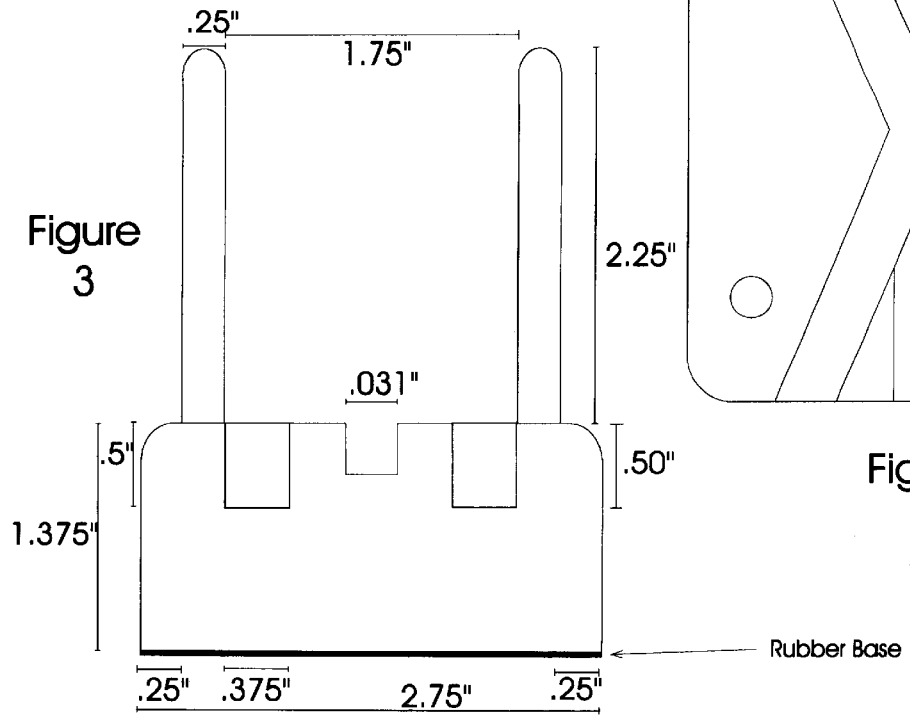
FIG. 3 represents the side view of the Kayak Beverage Holder. Shown are the body, vertical posts used to secure the beverage container, the center/crossing channels in which the stretch cord materials are confined, and the rubber base of one of the parallel sides.
Figure 4:
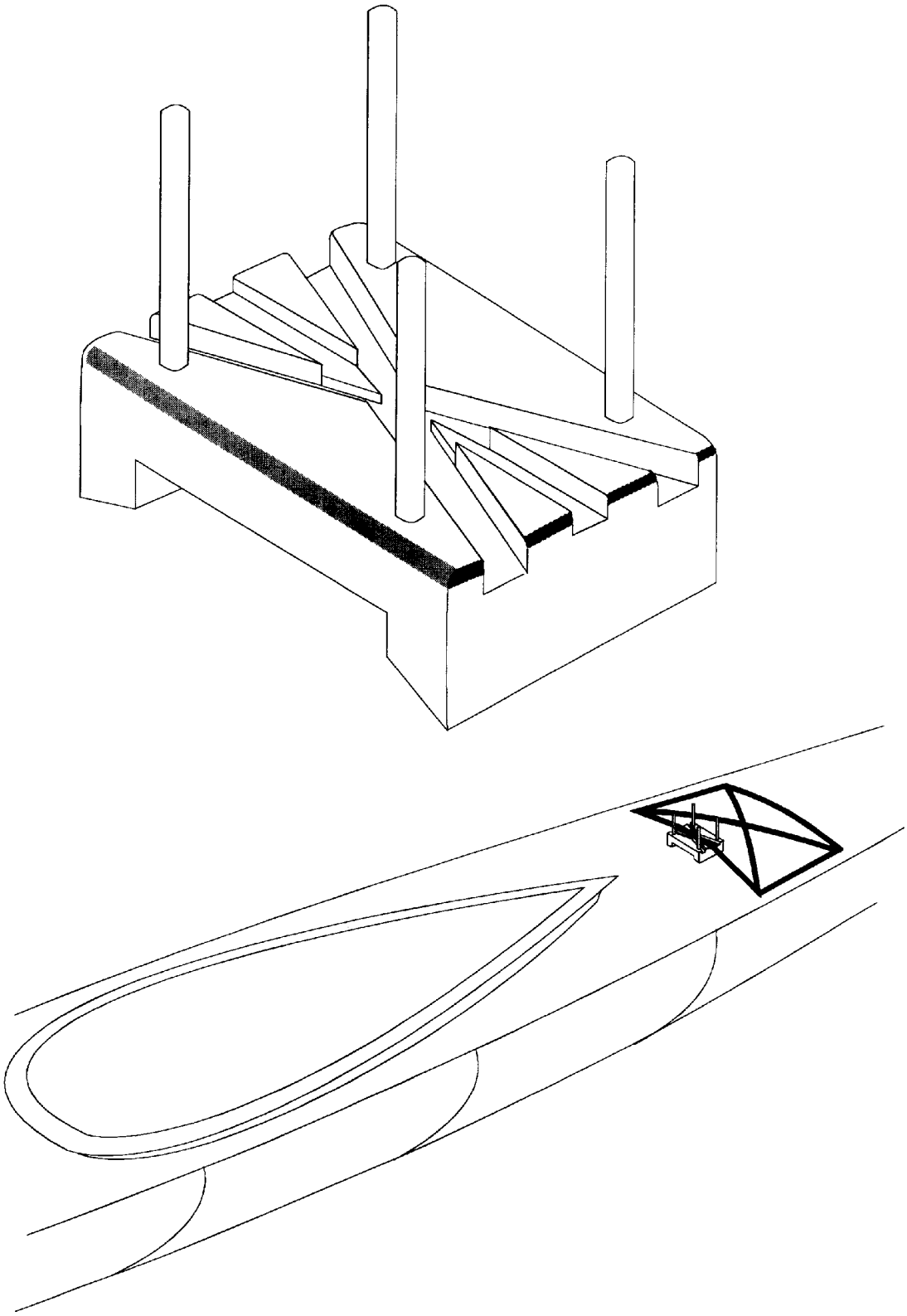
FIG. 4 shows a perspective drawing provided for patent publication and a drawing depicting the Kayak Beverage Holder as seen mounted on the forward deck of a kayak.

The Kayak Beverage Holder is a single unit with no moving or removable parts. It is built to the dimensions indicated on Page 1 of 2 in the attached drawings and can be constructed of wood or synthetic materials of a sufficient strength to withstand reasonable stress, particularly in the intersections of the body and the posts. The spacing of the posts on the top side of the unit allows for the insertion of a standard twelve ounce aluminum can (2.5" diameter) or a bottle of equal or lesser diameter. The height of the posts is sufficient to keep the beverage container from escaping the confinement of the four posts but not so tall as to obstruct easy removal of the beverage container. The Kayak Beverage Holder relies on gravity to hold the beverage container in place and will not function properly at angles exceeding fifty degrees. The unit is made with three channels, cut or molded, spanning the top from side to side in an "X" pattern bisected by a straight channel running from the dead center of the left side to the dead center of the right side. The channels are of sufficient depth to confine a single stretch cord (0.25" in diameter) across the center channel or two stretch cords overlapping each other (0.5" in combined height) in the X channels. The stretch cord attached to the kayak is used to temporarily fasten the Kayak Beverage Holder firmly to the deck of the kayak in an upright position and is required to allow the Kayak Beverage Holder to function as designed. Sufficient flat surfaces remain on the top side of the unit to provide an even footing for the bottom of the beverage container. A tunnel is cut or molded on the bottom side of the unit to a sufficient depth to allow clearance for a variety of deck shapes ranging from flat to an inverted "V". The left and right parallel bases are canted vertically toward the tunnel and have a rubber material fastened to them to provide a non-skid contact surface.

What is claimed is:

1. A kayak beverage holder formed as a single unit with no moving or removable parts comprising:

a body having a top and a tunnel defined by a bottom surface and parallel lower side bases, the tunnel and sides provide clearance for a flat, a rounded, or a v shaped kayak deck;

the parallel lower side bases are canted vertically toward the tunnel and have a rubber material fastened to them to provide non-skid contact surfaces;

four vertical posts extending from four corners of the body top within which a beverage container is held; and, the body further including three channels spanning completely across and cris-crossing the top, the channels sized to confine stretch cord material used as hold downs in either a straight or x pattern.

* * * * *